US011245999B2

(12) United States Patent
Kim

(10) Patent No.: US 11,245,999 B2
(45) Date of Patent: Feb. 8, 2022

(54) STEREOPHONIC SERVICE APPARATUS, OPERATION METHOD OF THE DEVICE, AND COMPUTER READABLE RECORDING MEDIUM

(71) Applicants: Digisonic Co., Ltd., Seoul (KR); Ji-heon Kim, Incheon (KR)

(72) Inventor: Ji-heon Kim, Incheon (KR)

(73) Assignee: 'Digisonic Co. Ltd., Seoul (KR)

( * ) Notice: Subject to any disclaimer, the term of this patent is extended or adjusted under 35 U.S.C. 154(b) by 546 days.

(21) Appl. No.: 16/098,027

(22) PCT Filed: Aug. 31, 2018

(86) PCT No.: PCT/KR2018/010173
§ 371 (c)(1),
(2) Date: Oct. 31, 2018

(87) PCT Pub. No.: WO2019/059558
PCT Pub. Date: Mar. 28, 2019

(65) Prior Publication Data

US 2021/0176577 A1 Jun. 10, 2021

(30) Foreign Application Priority Data

Sep. 22, 2017 (KR) ..... 10-2017-0122318
Sep. 29, 2017 (KR) ..... 10-2017-0127974
Sep. 29, 2017 (KR) ..... 10-2017-0128117
Aug. 16, 2018 (KR) ..... 10-2018-0095249
Aug. 16, 2018 (KR) ..... 10-2018-0095256

(51) Int. Cl.
*H04R 3/00* (2006.01)
*H04S 3/00* (2006.01)
*H04S 7/00* (2006.01)

(52) U.S. Cl.
CPC ..... *H04S 3/008* (2013.01); *H04S 7/303* (2013.01); *H04S 2400/01* (2013.01); *H04S 2420/01* (2013.01)

(58) Field of Classification Search
CPC ..... H04S 3/008; H04S 7/303; H04S 2400/01; H04S 2420/01
See application file for complete search history.

(56) References Cited

U.S. PATENT DOCUMENTS 5,729,612 A * 3/1998 Abel ..... H04R 29/001 381/1
2013/0177166 A1* 7/2013 Agevik ..... H04R 3/00 381/74

(Continued)

*Primary Examiner* — Jason R Kurr
(74) *Attorney, Agent, or Firm* — Howson & Howson LLP

(57) ABSTRACT

The present invention relates to a stereophonic service apparatus, its method of driving, and a computer readable recording medium. The stereophonic sound service apparatus according to an embodiment of the present invention may include the storage unit which matches and stores HRTF data related to a physical characteristic of a user and the sound source environment 3D data related to the sound source environment; and the control unit that extracts an HRTF candidate group from HRTF data stored based on a test result of a user for sound matching and setting at least one of data having a similarity value equal to or higher than a reference value as individualized data for each user.

6 Claims, 9 Drawing Sheets

(56) References Cited

U.S. PATENT DOCUMENTS

| | | | | |
|---|---|---|---|---|
| 2014/0198918 | A1* | 7/2014 | Li | H04S 7/30 381/26 |
| 2015/0010160 | A1* | 1/2015 | Udesen | H04R 25/70 381/60 |
| 2018/0310115 | A1* | 10/2018 | Romigh | H04S 3/008 |
| 2019/0208348 | A1* | 7/2019 | Reijniers | H04S 7/303 |

* cited by examiner

STEREOPHONIC SERVICE APPARATUS, OPERATION METHOD OF THE DEVICE, AND COMPUTER READABLE RECORDING MEDIUM

FIELD OF THE INVENTION

This invention is related to stereophonic service apparatus, its method of operation, and computer readable recording media and more specifically, the stereophonic service apparatus, its method of operation and computer readable recording media, which allow users to listen to music through 3D earphones considering their unique physical characteristics and the actual sound-source environment.

BACKGROUND OF THE INVENTION

The sound technology that started in monaural is now evolving from stereo (2D) to stereophonic (3D) technology that sounds as it is actually heard in the field. 3D sound technology has long been used in the film industry. It is also being used as a tool to increase immersion in the field of computers such as in computer games. It is an important factor that multiplies the reality of 3D information included in images and videos.

Stereophonic technology is a technology that allows a listener, located in a space which is not the space where the sound source occurs, to perceive the same senses of direction, distance, and space as in the space where the sound source occurs. Using stereophonic technology, the listener can feel as if he or she is listening in the actual field. Stereophonic technology has been studied for decades to provide the listener with a 3-dimensional sense of space and direction. However, as digital processors have been speeding up, and various sound devices have been dramatically developed in the 21st century, stereophonic technology has been getting more and more popular.

Research on these 3-dimensional audio technologies has been carried out continuously. Among them, researchers have found that processing audio signals using an "individualized head-related transfer function (HRTF)" can play the most realistic audio. In an audio signal processing method using a conventional head-related transfer function, a microphone is put into the ear of a human or a human model (for example, torso), and an audio signal is recorded to obtain an impulse response and, when it is applied to an audio signal, the position of the audio signal in the 3 dimensional space can be sensed. Here, the head-related transfer function represents a transfer function that occurs between a sound source and a human ear, which not only varies according to the azimuth and altitude of the sound source, but also varies depending on physical characteristics such as the human head shape/size, and ear shape. That is, each person has a unique head-related transfer function. However, there is a problem that it is difficult to provide the same 3-dimensional sound effect to those who have different physical characteristics, since, until now, only the head-related transfer function (that is, the HRTF which is not individualized), measured through various kinds of models (for example, a dummy head), has been used for 3 dimensional audio signal processing.

An additional problem is that a user cannot be provided with a realistic 3-dimensional audio signal optimized for that user because the conventional multimedia reproduction system does not have a module that can apply a head-related transfer function to each user's own body to fit the user's body characteristics.

SUMMARY OF THE INVENTION

Problem to be Solved

An embodiment of the present invention is to provide a stereophonic service apparatus, its operational method, and a computer readable recording medium, enabling a user to listen to music through a 3D earphone considering the user's own physical characteristics and an actual sound source environment.

Method for Solving the Problems

A stereophonic service apparatus according to an embodiment of the present invention includes a storage unit for matching head-related transfer function (HRTF) data related to a physical characteristic of a user, and sound source environment (3D) data related to the sound source environment of the user. It also includes a control unit extracting an HRTF data candidate group related to the user from the stored HRTF data and setting one piece of data selected from the extracted candidate as individualized HRTF data for each user based on the stored sound source environment data matching the sound source environment test result provided by the user.

The storage unit stores sound source environment data matched to each piece of HRTF data, and each piece of sound source environment data may relate to a plurality of signals obtained by dividing a frequency characteristic and a time difference characteristic of an arbitrary signal into a plurality of sections, respectively.

The control unit may extract the sound source environment data related to the plurality of signals matched with the sound source environment test result by the candidate group.

The control unit may perform an impulse test to determine an inter-aural time difference (ITD), an inter-aural level difference (ILD), and a spectral cue through the sound output apparatus of the user to obtain the sound source environment test result.

The control unit may use a game application (App.) to test impulse through the sound output apparatus by providing a specific impulse sound source to the user to determine the location of the sound source. The control unit may measure the degree of similarity between the HRTF data of the extracted candidate group and the stored HRTF data, and set the candidate having the largest similarity measurement value as the individualized HRTF data of the user.

The stereophonic service apparatus may further include a communication interface unit for providing the set individualized data to the user's stereophonic output apparatus when the user requests.

The control unit may control the communication interface unit to provide a streaming service which the user applies, and converts audio or video to be played back by using the individualized data.

Also, an embodiment of the present invention is an operation method of a stereophonic service apparatus that includes a storage unit and a control unit, and there are steps to match head-related transfer function (HRTF) data related to the user's physical characteristics and sound source (3D) data related to the above user's sound source environment to be stored in the above storage, and extracting an HRTF data candidate group related to the user from the stored HRTF data and setting one piece of data selected from the extracted candidate as individualized HRTF data for each user based on the stored sound source environment data matching the sound source environment test result provided by the user.

The above storing step stores the sound source environment data matched to each piece of HRTF data, each of which can be related to multiple signals obtained by dividing the frequency and time difference characteristics of an arbitrary signal into multiple segments.

The above setting step may be used to extract the sound source environment data associated with multiple signals corresponding to the above results of the sound source environment tests.

The above setting step may include a step performing impulse test to find out inter-aural time difference (ITD), an inter-aural level difference (ILD) and a spectral cue (spectral queue) through the above user's sound output device to obtain sound source environment results. The above step may include the use of game applications (App.) to determine the location of the sound source by making certain impulses sound sources available to the users through the above sound output apparatus.

The above step may measure the degree of similarity between the HRTF data of the extracted candidate group and the stored HRTF data, and set the candidate having the largest similarity measurement value as the individualized HRTF data of the user.

The operation of the above stereophonic service apparatus may include further steps to provide the set of individualized data to the stereophonic output apparatus of the user by the communication interface unit when there is a request from the user.

The above setting step may include the step of controlling the communication interface unit to provide a streaming service which the user applies and converts audio or video to be played back by using the individualized data.

Meanwhile, in a computer readable recording medium including a program for executing a stereophonic service method, the stereo sound service method executes a matching step for matching head-related transfer function (HRTF) data related to the physical characteristics of the user and sound source environment (3D) data related to the sound source environment of the user, and an extraction step for extracting an HRTF data candidate group related to the user from among the stored HRTF data and setting one piece of data selected from the extracted candidate groups as individualized HRTF data for each user based on the stored sound source environment data matching the sound source environment test result provided by the user.

Effects of the Invention

According to the embodiment of the present invention, it is possible not only to provide a customized stereophonic sound source reflecting the user's own physical characteristics, but also to enable the sound output in an environment similar to the actual sound environment so that users will be able to enjoy the same 3 dimensional sound effects with their stereophonic earphones no matter how different their physical characteristics are.

In addition, even if a user does not purchase a product separately equipped with a module such as a stereophonic earphone to enjoy a sound effect, an optimal sound service can be utilized simply by installing an application in his/her sound output device.

DETAILED DESCRIPTION OF THE INVENTION

Figure 1:
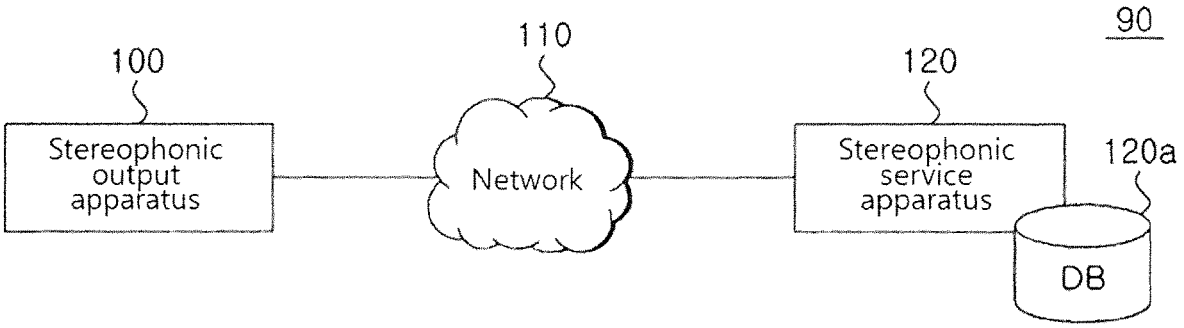
FIG. 1 is a drawing showing a stereophonic service system according to the embodiment of present invention.

Referring to the drawings below, the embodiment of the present invention is explained in detail.

FIG. 1 is a drawing to show the stereophonic service system according to the embodiment of the present invention. As illustrated in FIG. 1, the stereophonic service system 90 according to the embodiment of the present invention includes the stereophonic output apparatus 100, the network 110, and a part or all of the stereophonic service apparatus 120. The term "includes a part or all" means that a stereophonic output apparatus 100 itself furnishes a module to provide the services of the present invention, e.g., hardware and software, and it operates in the form of a stand-alone apparatus, or the communication network 110 may be omitted so that the stereophonic output apparatus 100 and the stereophonic service apparatus 120 perform direct, e.g., P2P communication, and further, some components such as the stereophonic service apparatus 120 can be configured in a network device (e.g., an AP, an exchange apparatus, etc.) of the communication network 110. It is described as including in its entirety to aid a good understanding of the invention.

A stereophonic output apparatus 100 includes various types of device such as devices that only output audio or devices that output audio as well as video: speakers, earphones, headphones, MP3 players, portable multimedia players, cell phones, e.g., smart phones, DMB players, smart TVs, and home theaters. Advantages of the present invention can be realized in an embodiment utilizing 3D earphones.

A stereophonic output apparatus 100 may include a program or application that allows a particular user to output individualized sound at the time of product release. Therefore, the user can execute the application of the stereophonic sound output apparatus 100, for example, and set the optimized sound condition for the user. For this, the user can apply his/her specific physical characteristics such as the head-related transfer function (herein after, HRTF), and set the specialized sound condition specific to himself/herself, considering the actual sound source environment in which the user is mainly active. This sound condition may be used to change the sound source such as a song that the user is trying to execute.

Of course, the stereophonic output apparatus 100 may be connected to the stereophonic service apparatus 120 of FIG. 1 through a terminal device such as a smart phone, for example, which is a stereophonic play apparatus to perform an operation for setting the sound condition as described above. Then, the program or data related to the set condition is received and stored in the stereophonic output apparatus 100, and the audio executed using the stored data can be heard in an optimized environment. Here, the "optimized environment" includes an environment by at least individualized HRTF data. Of course, it is possible to be provided a streaming service by providing the audio file desired by the user in the stereophonic output apparatus 100 to the stereophonic service apparatus 120, or by executing the corresponding audio file in the stereophonic sound apparatus 120 through this process.

As described above, since the stereophonic output apparatus 100 and the stereophonic service apparatus 120 can be interlocked in various forms, it will not be particularly limited to one specific form in the embodiment of the present invention. However, when a streaming service is provided, the service may not be smooth when a load on the communication network 110 occurs, so it is preferable to execute a specific audio file (e.g., a music file) after it is stored in the stereophonic output apparatus 100, and apply the optimized sound condition. A more detailed example will be covered later.

The communication network 110 includes both wired and wireless communication networks. A wired/wireless Internet network may be used or interlocked as the communication network 110. This means that the wired network includes an Internet network such as a cable network or a public switched telephone network (PSTN), and the wireless communication network includes CDMA, WCDMA, GSM, Evolved Packet Core (EPC), Long Term Evolution (LTE), a Wireless Broadband (WiBro) network, and so on. Of course, the communication network 110 according to the embodiment of the present invention is not limited to this, and it can be used as an access network of a next generation mobile communication system to be implemented in the future, for example, a 5G network and a cloud computing under in a cloud computing network environment. For example, if the communication network 110 is a wired communication network, it may be connected to a switching center of a telephone network in the communication network 110. However, in the case of a wireless communication network, it may be connected to an SGSN or a Gateway GPRS SupportNode (GGSN) to process the data, or connected to various repeaters such as Base Station Transmission (BTS), NodeB, and e-NodeB to process the data.

The communication network 110 includes the access point (AP). The access point includes a small base station such as a femto or pico base station, which is installed in a large number of buildings. Here, the femto or pico base station is classified according to the maximum number of the stereophonic output apparatuses 100 that can be connected in the classification of the small base stations. Of course, the access point includes a stereophonic output device 100 and a short-range communication module for performing short-range communication such as ZigBee and Wi-Fi. The access point can use TCP/IP or Real-Time Streaming Protocol (RTSP) for wireless communication. Here, the short-range communication may be performed by various standards like Bluetooth, ZigBee, IrDA, Ultra High Frequency (UHF) and Radio Frequency (RF) like Very High Frequency (VHF) and Ultra Wide Band (UWB) and so on, besides Wi-Fi. Accordingly, the access point can extract the location of the data packet, specify the best communication path for the extracted location, and forward the data packet along the designated communication path to the next device, e.g., the stereophonic service apparatus 120. The access point may share a plurality of lines in a general network environment, and may include, for example, a router, a repeater and so on.

The stereophonic service apparatus 120 provides an individualized stereophonic service to the user of the stereophonic output apparatus 100. Here, "individualized stereophonic service" is to provide stereophonic service based on the setting value most similar to the physical characteristics of a specific user and the actual sound source environment for each user. More precisely, it can be said to be a set value reflecting the physical characteristics of the selected user in consideration of the actual sound source environment. For example, if the stereophonic service apparatus 120 is a server providing music service, the audio data is processed based on the set values and provided to the stereophonic output apparatus 100. According to the embodiment of the present invention, the stereophonic service apparatus 120 would be possible to change external factors such as a hardware (e.g. equalizer) for changing an internal factor such as a sound field of the audio signal itself or outputting an audio signal based on the set value (e.g. individualized HRTF data).

In more detail, the stereophonic service apparatus 120 according to the embodiment of the present invention can operate in conjunction with the stereophonic output apparatus 100 in various forms. For example, when the stereophonic output apparatus 100 requests downloading of an application to use a service according to an embodiment of the present invention, the application can be provided. Here, the application helps to select the sample data best suitable to the user's physical characteristic (or sound source environment) based on user's input information (e.g., test result) among previously stored matching sample data (e.g., about 100 generalized HRTF data). To do this, for example, a game app that plays a specific impulse sound source to the user and grasps the location of a sound source is matched with one hundred sample data to find the expected HRTF in the process, and the similarity with one hundred models is measured to find the most similar value. As a result, the sound source can be adjusted (or corrected) based on the finally selected individualized data and provided to the user.

Of course, this operation may be performed by the stereophonic service apparatus 120 after the connection to the stereophonic service apparatus 120 by the execution of the application in the stereophonic output apparatus 100. In other words, the matching information is received by the interface with the user via the stereophonic output device 100 such as a smart phone, and the stereophonic service apparatus 120 selects the individualized HRTF from the sample data based on the matching information to provide an individualized stereophonic service based on this.

For example, as the stereophonic service apparatus 120 provides the selected data to the stereophonic output apparatus 100, the audio signal may be corrected based on the data, for example, scaled to output audio when the stereophonic output apparatus 100 executes the music file stored in the inside or provided from the outside. Also, in the case of providing a music service, the stereophonic service apparatus 120 would possibly execute the file by converting a music file based on data of a specific user and provide the converted music file to the stereophonic output apparatus 100 in the form of a file when providing a specific music file. In addition, the stereophonic service apparatus 120 may convert audio based on individualized HRTF data of a specific user and provide services to the stereophonic output apparatus 100 by streaming.

As described above, the stereophonic service apparatus 120 according to the embodiment of the present invention can operate with the stereophonic output apparatus 100 in various forms, and of course it may be possible to have all of the above actions together. This is determined according to the intention of the system designer; and therefore, the embodiment of the present invention is not limited to the one kind of form.

On the other hand, the stereophonic service apparatus 120 includes a DB 120*a*. The stereophonic service apparatus 120 not only stores sample data for setting individualized HRTF data for each user in the DB 120*a*, and also stores individualized HRTF data set for each user using sample data. Of course, the HRTF data herein may be stored in a matching environment of the sound source environment data for allowing the user to know the actual sound source environment for each user. Or stored separately, it may be possible to find specific individually specialized HRTF data, find the sound source environment data specialized for a specific individual, and combine them with each other.

Figure 2:
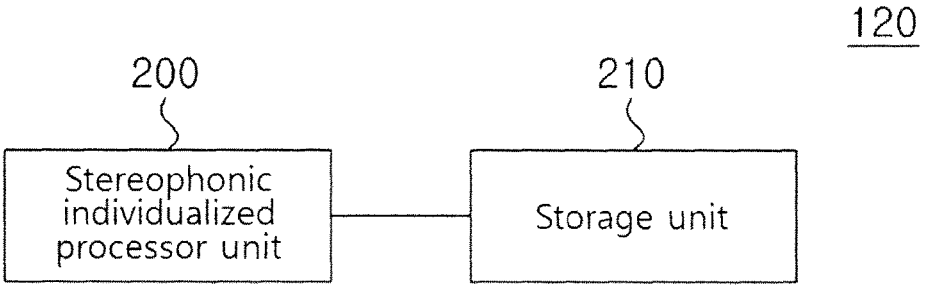
FIG. 2 is a block diagram showing the structure of a stereophonic service apparatus of FIG. 1.

FIG. 2 is a block diagram illustrating the structure of the stereophonic service apparatus of FIG. 1.

As exemplary in FIG. 2, the stereophonic service apparatus 120 according to the first embodiment of the present invention includes part or all of the stereophonic individualized processor unit 200 and the storage unit 210, and the "part or all" means the same as the preceding meaning.

The stereophonic individualized processor unit 200 sets individualized sound data for each user. Here, the individualized sound data may include HRTF data related to the physical characteristics of each user, and may further include sound source environment data related to an actual sound source environment for each user matching the HRTF data.

The stereophonic individualized processor unit 200 finds data suitable for a specific user from a plurality of sample data stored in the storage unit 210 based on input information by an interface, e.g., touch input or voice input with the user, and sets the found data as data that is specific to the user. Also, when the audio service is provided, an operation of changing the audio using the setting data is performed. Of course as described above, the stereophonic individualized processor unit 200 can also provide data suitable for a specific user to the sound output apparatus 100 of FIG. 1 to use the corresponding data in the sound output apparatus 100, but the embodiment of the present invention is not particularly limited to any one.

The storage unit 210 may store various data or information to be processed by the stereophonic individualized processor unit 200. Here, the storage includes temporary storage. For example, the DB 120*a* of FIG. 1 may receive and store sample data for individualized processing. Also, the stereophonic individualized processor unit 200 may provide corresponding sample data upon request.

In addition, the storage unit 210 may store HRTF data and sound source environment data, which are individualized for each user, by using the provided sample data, matching with the user identification information. Also, the stored data may be provided at the request of the stereophonic individualized processor unit 200 and stored in the DB 120*a* of FIG. 1.

In addition to the above, the stereophonic individualized processor unit 200 and the storage unit 210 of FIG. 2 are not significantly different from those of the stereophonic service apparatus 120 of FIG. 1, so it is substituted with the previous contents.

Figure 3:
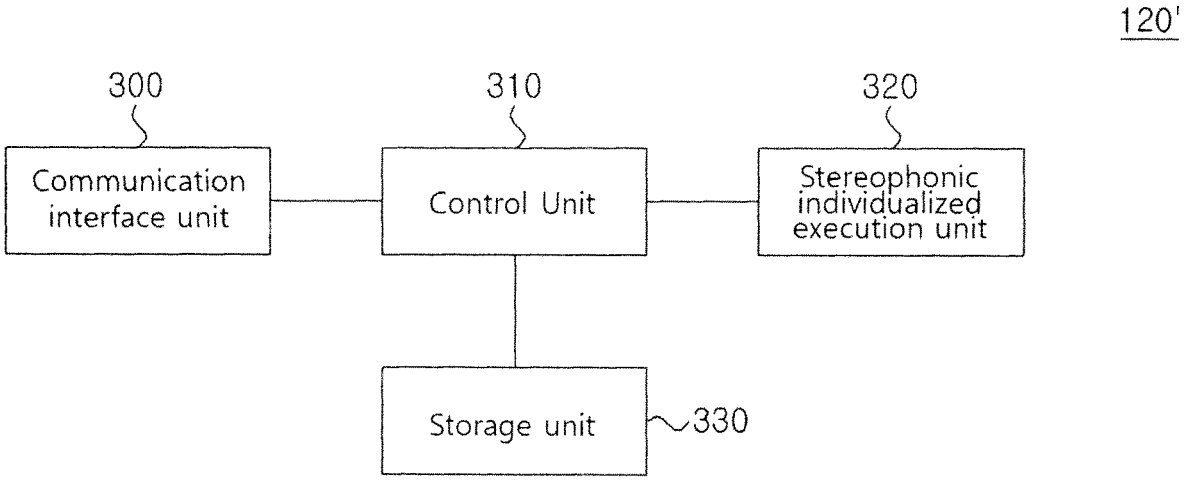
FIG. 3 is a block diagram showing the different structure of a stereophonic service apparatus in FIG. 1.

FIG. 3 is a block diagram showing another structure of the stereophonic service apparatus of FIG. 1. As shown in FIG. 3, the stereophonic service apparatus 120' according to another embodiment of the present invention includes a part or all of communication interface unit 300, a control unit 310, a stereophonic individualized execution unit 320, and a storage unit 330. Here, "part or all" means that some components such as the storage unit 330 may be omitted or some components such as the stereophonic individualized execution unit 320 may be integrated into other components such as the control unit 310. It is described as including in its entirety to aid a good understanding of the invention.

The communication interface unit 300 may provide an application for a stereophonic service according to an embodiment of the present invention at the request of a user. In addition, the communication interface unit 300 connects the service when the application is executed in the sound output apparatus 100 such as a smart phone connected with a 3D earphone. In this process, the communication interface unit 300 may receive the user identification information ID and transmit the user identification information ID to the control unit 310. In addition, the communication interface unit 300 receives the user input information for selecting the sound source environment data related to the HRTF individualized by the user and the sound source environment for each user, and transmits the input information to the control unit 310. In addition, the communication interface unit 300 may provide individualized HRTF data or sound source environment data to the sound output apparatus 100, or may provide an audio sound source reflecting the corresponding data in a streaming form or in a file form. For example, one specific song can be converted and provided in accordance with the user's physical characteristics and actual environment.

The control unit 310 controls the overall operation of the communication interface unit 300, the stereophonic individualized execution unit 320, and the storage unit 330 constituting the stereophonic service apparatus 120'. For example, the control unit 310 executes the stereophonic individualized execution unit 320 based on the user input information received through the communication interface unit 300 according to a user's request, and finds individualized data for each user matching the input information. More specifically, the control unit 310 may execute a program in the stereophonic individualized execution unit 320, and provide the input information provided in the communication interface unit 300 to the stereophonic individualized execution unit 320. In addition, the control unit 310 can control the communication interface unit 300 to be saved at the DB 120*a* of FIG. 1 after receiving the HRTF data and the sound source environment data set for each user from the stereophonic individualized execution unit 320 and temporarily storing them at the storage unit 330. At this time, it is preferable to match and store the user identification information together. As described above, the stereophonic individualized executing unit 320 performs an operation of setting individualized HRTF data and sound source environment data for each user, and more specifically, it can perform searching for individualized HRTF data through the sound source environment data, and further convert the audio based on the set data. In practice, such an audio conversion may include an operation of converting various characteristics such as the frequency or time of the basic audio based on data set as a correction operation. The content of the storage unit 330 is not so different from that of the storage unit 210 of FIG. 2.

The detailed contents of the communication interface 300, the control unit 310, the stereophonic individualized execution unit 320 and the storage unit 330 of FIG. 3 are not much different from those of the stereophonic service apparatus 120 of FIG. 1.

Meanwhile, the control unit 310 of FIG. 3 may include a CPU and a memory as another embodiment. Here, the CPU may include a control circuit, an arithmetic logic circuit ALU, an analysis unit, and a registry. The control circuit is related to the control operation, the arithmetic logic circuit can perform various digital arithmetic operations, and the analysis unit can help the control circuit to analyze the instructions of the machine language. A registry is related to data storage. Most of all, memory can include RAM and the control unit 310 can store the program stored in the stereophonic individualized execution unit 320 in an internal memory at the initial operation of the stereophonic service apparatus 120' and by executing this, the operation speed can be increased rapidly.

Figure 4:
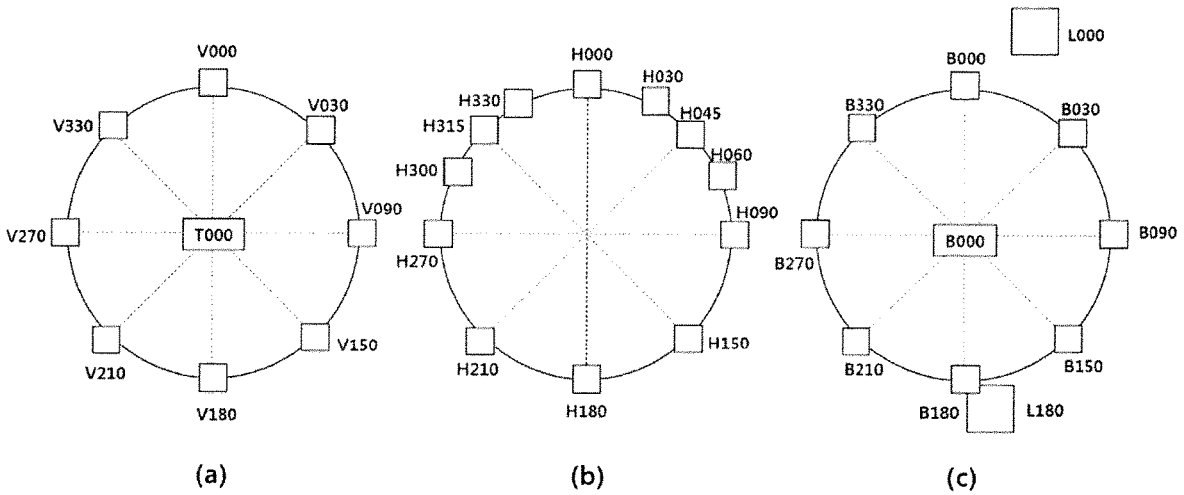
FIG. 4 and FIG. 5 are drawings to describe the stereophonic sound as frequency characteristics change.
Figure 5:
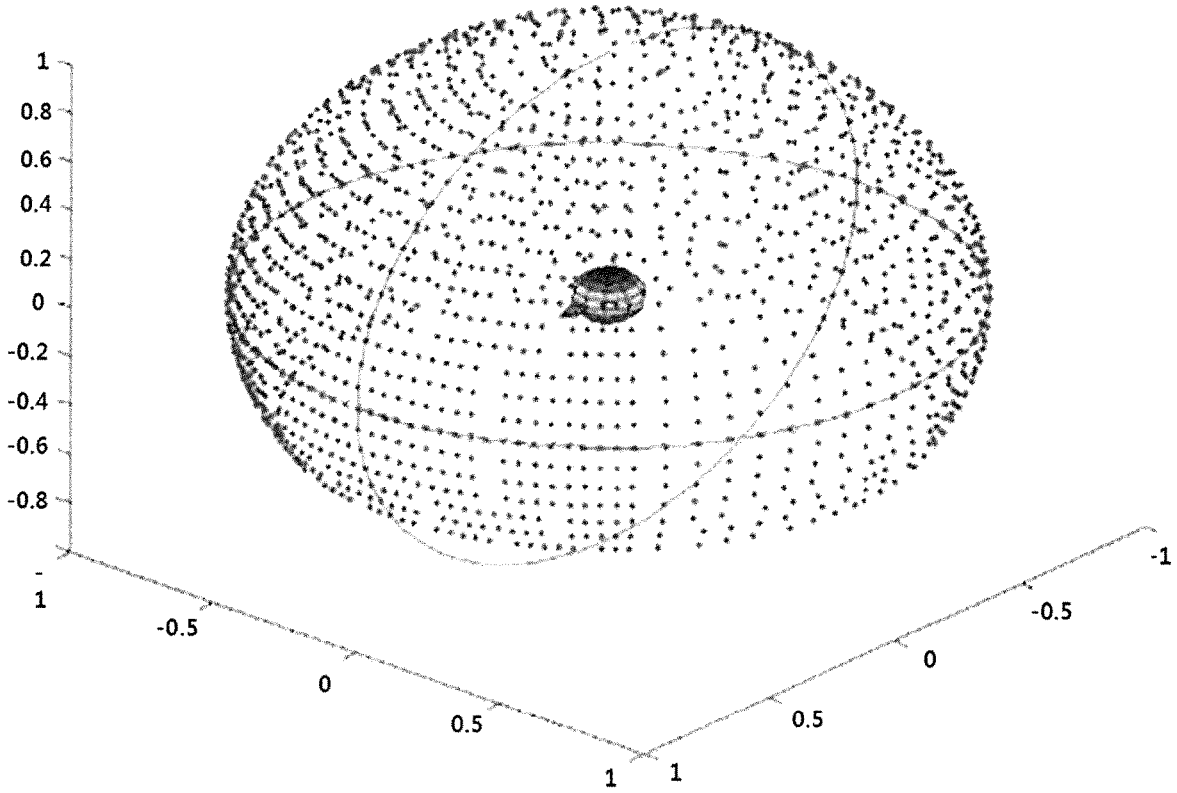
Figure 6:
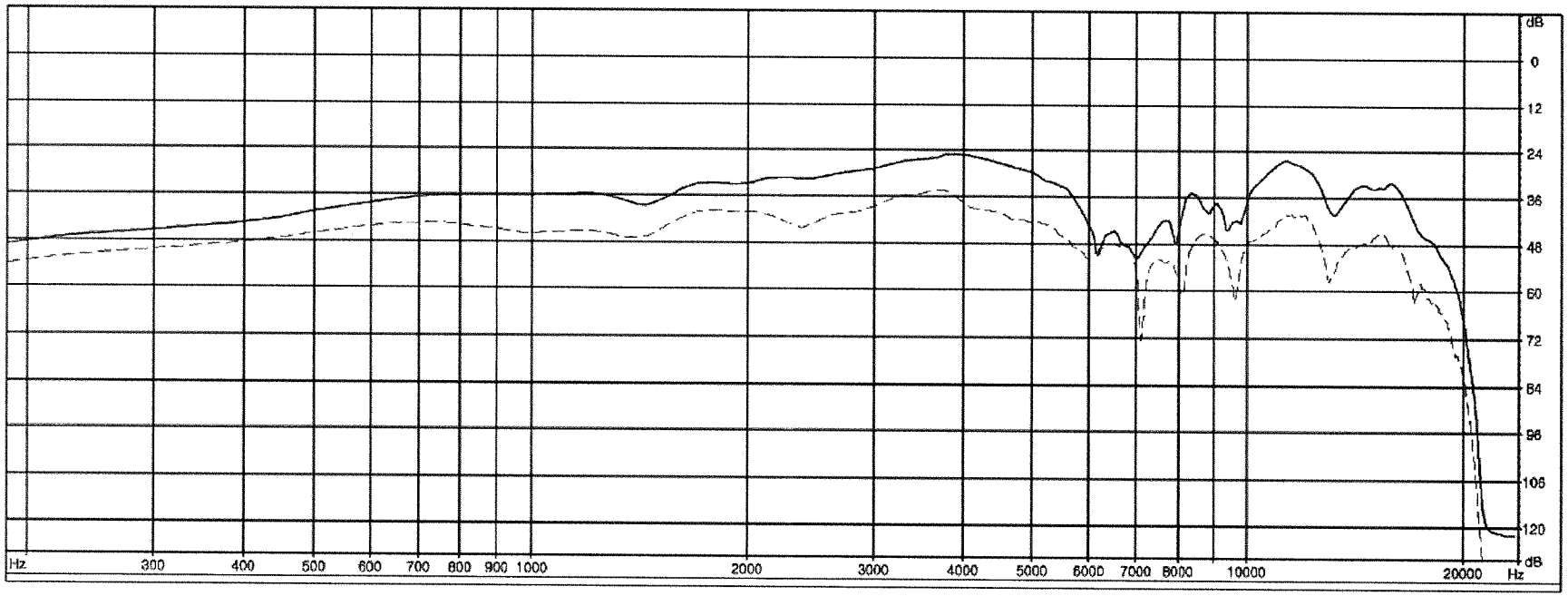
FIG. 6 is a drawing to show the frequency characteristics of an angle difference of 0 to 30 degrees.
Figure 7:
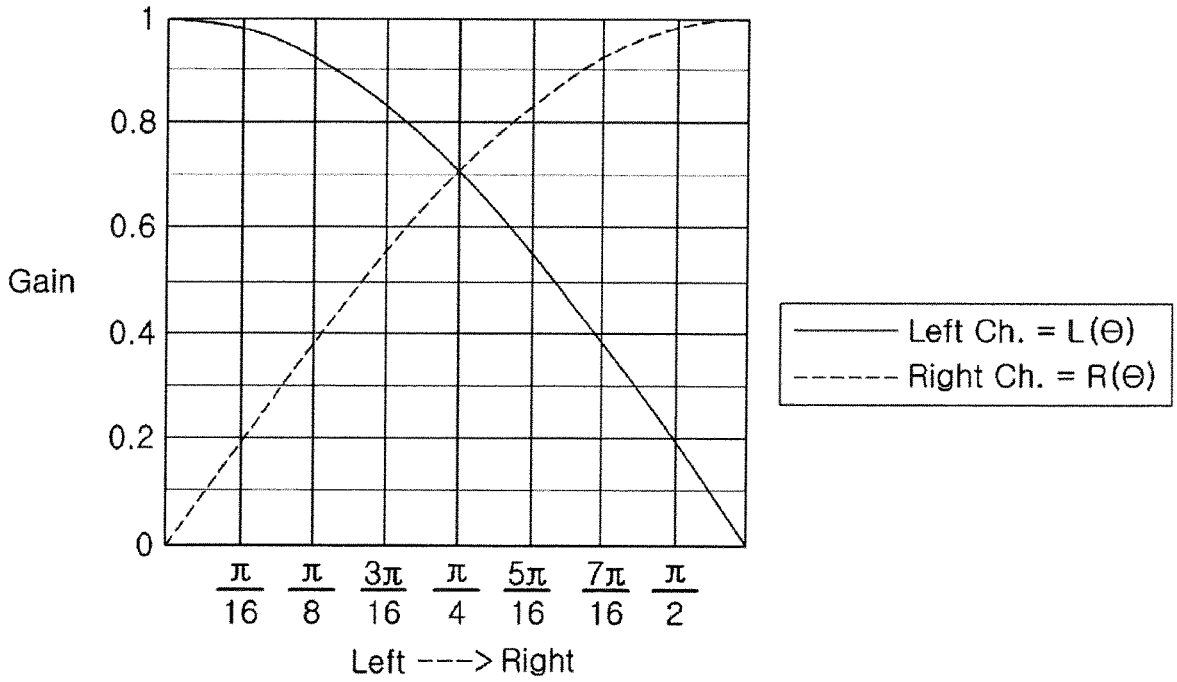
FIG. 7 is a drawing to show the results of calculating the intermediate change values of 5 degrees, 15 degrees, 20 degrees, and 25 degrees.
Figure 8:
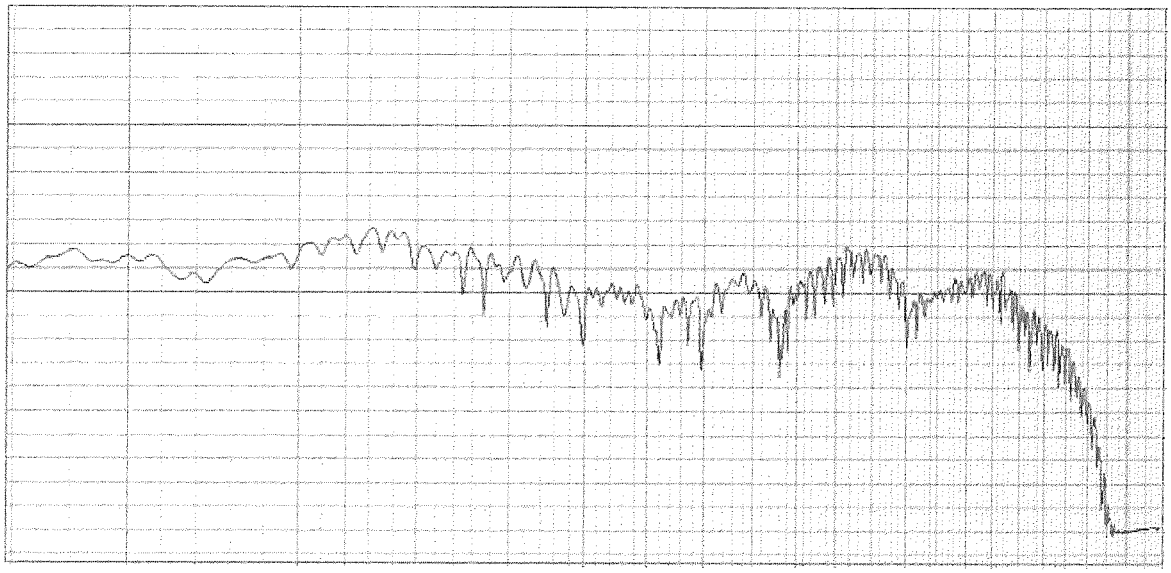
FIG. 8 is a drawing to show rapid frequency response changes.
Figure 9:
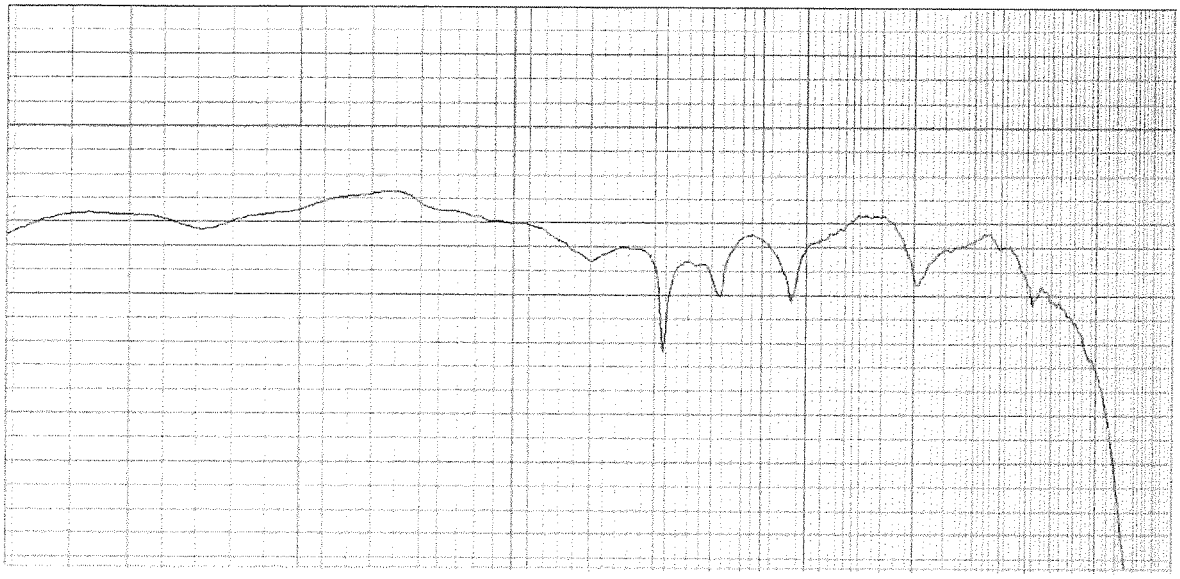
FIG. 9 is a drawing to show the impulse response characteristics of actual hearing changes with ⅓ octave smoothing processing.

FIG. 4 and FIG. 5 are drawings for explaining stereophonic sound according to changes in frequency characteristics, and FIG. 6 is a drawing showing frequency characteristics of an angle difference of 0 to 30 degrees. Also, FIG. 7 is a drawing showing the results of arithmetic processing of intermediate change values at 5 degrees (°), 15 degrees, 20 degrees, and 25 degrees, FIG. 8 is a drawing showing a sudden change in frequency response, FIG. 9 is a drawing illustrating impulse response characteristics of actual auditory change through ⅓ octave smoothing processing, and FIG. 10 is a drawing for explaining directionality and spatiality in a natural reflection sound condition.

Figure 10:
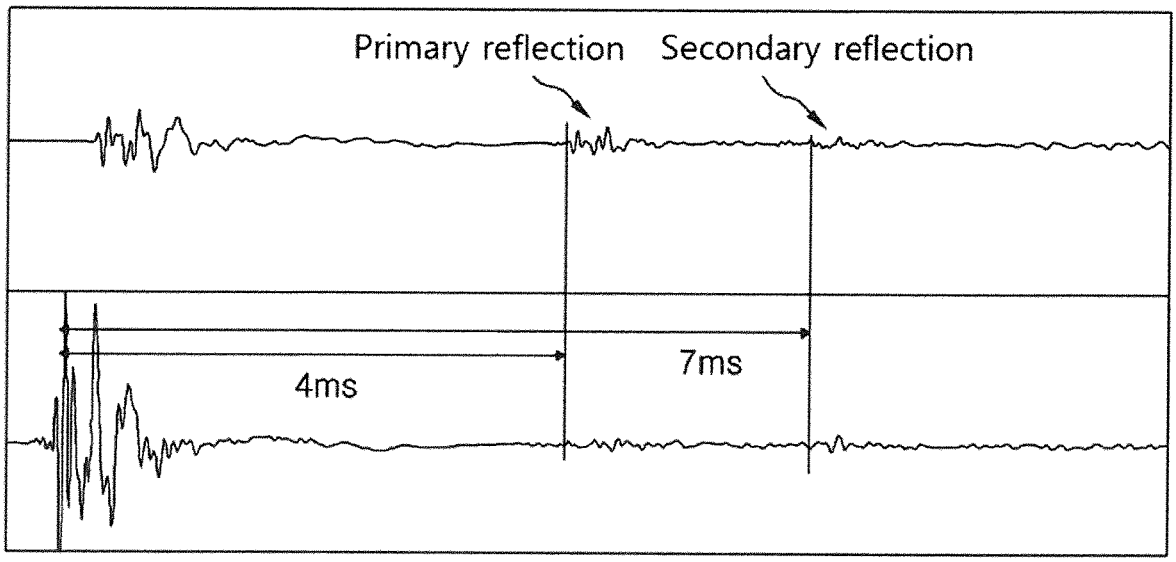
FIG. 10 is a drawing describing the direction and spatiality in a natural reflector condition.

FIG. 4 and FIG. 10 correspond to the drawings for explaining 3D filtering, for example, alpha filtering operation for generating sound source environment data as in the embodiment of the present invention. Such sound source environment data may be previously stored separately, but may be matched with the HRTF data and stored beforehand. According to an embodiment of the present invention, the sound source environment data is preferably stored in correspondence with each HRTF data. Alpha filtering according to an embodiment of the present invention is divided into a frequency characteristic change (or a transformation) and a time difference characteristic change, and the frequency characteristic change is performed by reducing a peak band of a specific frequency by a predetermined decibel (dB) and performs a smoothing operation on an octave band basis. Also, the time difference characteristic changes in the form of the original sound (or the fundamental sound)+predetermined time interval+primary reflection sound+predetermined time interval+secondary reflection sound+predetermined time interval+tertiary reflection sound.

The reason for advancing the frequency characteristic change in the embodiment of the present invention is as follows. A fully individualized HRTF should have thousands of directional function values, but applying this to real sound sources is a real problem. Therefore, as shown in FIG. 4, for example, the 30-degree angular sound source corresponding to thirty channels is matched with the sample data, and the intermediate point, for example, in 5-degree units of each direction point is implemented by filtering the intermediate value. FIG. 4(*a*) shows 9 channels of the top layer, FIG. 4(*b*) shows 12 channels of the middle layer, and FIG. 4(*c*) shows 9 channels of the bottom layer and 2 of LFE Low Frequency Effect channels. It can be seen that a real person recognizes a 3 dimensional sound source at a finer angle as shown in FIG. 5.

In addition, in order to change the frequency characteristic, the power level adjusting method can be used in the embodiment of the present invention. FIG. 6 shows the frequency characteristics of the angular difference between 0 and 30 degrees, and FIG. 7 shows the graph obtained by calculating the intermediate change values of 5 degrees, 15 degrees, 20 degrees and 25 degrees.

Since the abrupt frequency change is different from the actual human auditory sense characteristic, the abrupt change value is smoothed on the basis of the ⅓ octave band in order to obtain the frequency change value similar to the human auditory characteristic in the embodiment of the present invention. FIG. 8 shows the impulse response characteristic of the abrupt change, and FIG. 9 shows the impulse response characteristic of the actual auditory change through the ⅓ octave smoothing processing.

On the other hand, regarding the change in the time difference characteristic during the alpha filtering, it is necessary to change the characteristic so that the sample data having the time difference based on the 30-degree angle can be converted into the accurate angle in 5-degree units in real time. At this time, according to the embodiment of the present invention, the change of the time difference characteristic may be performed by applying a change value in each direction in one sample unit in the EX-3D binaural renderer software (SW). Accordingly, when the sound source is positioned in real time based on the latitude and longitude, it is possible to have natural sound source movement and maintain the intelligibility.

A closer look at the changes in the time difference characteristics reveals that humans hear sound in a space where natural reflections exist, rather than hear sounds in an anechoic chamber, and directionality and spatial sensibility become naturally recognizable in natural reflections. Thus, natural initial reflections reflected in the space are added to the head-related impulse response (HRTF) to form head-related impulse responses (HRIR), thereby improving the 3 dimensional spatial audio. FIG. 10 shows the formation of HRIR according to the reflected sound.

The change in frequency characteristics during alpha filtering improves the quality of the sound source and the sound image accuracy by providing a natural angle change and frequency characteristic change when matching the HRTF of an individual. In addition, in order to realize a natural 3 dimensional spatial audio, the time characteristic change can be realized by mixing the HRTF and the Binaural Room Impulse Response (BRIR), thereby reproducing and transmitting the sound source in a manner similar to the actual human auditory sense characteristic will be.

Figure 11:
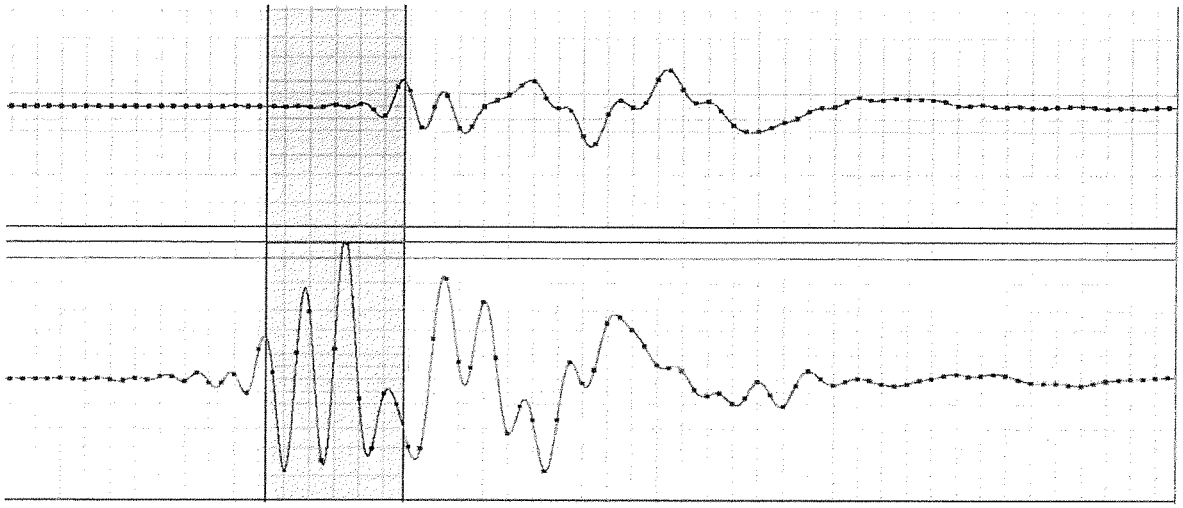
FIG. 11 is a drawing to explain the ITD matching.
Figure 12:
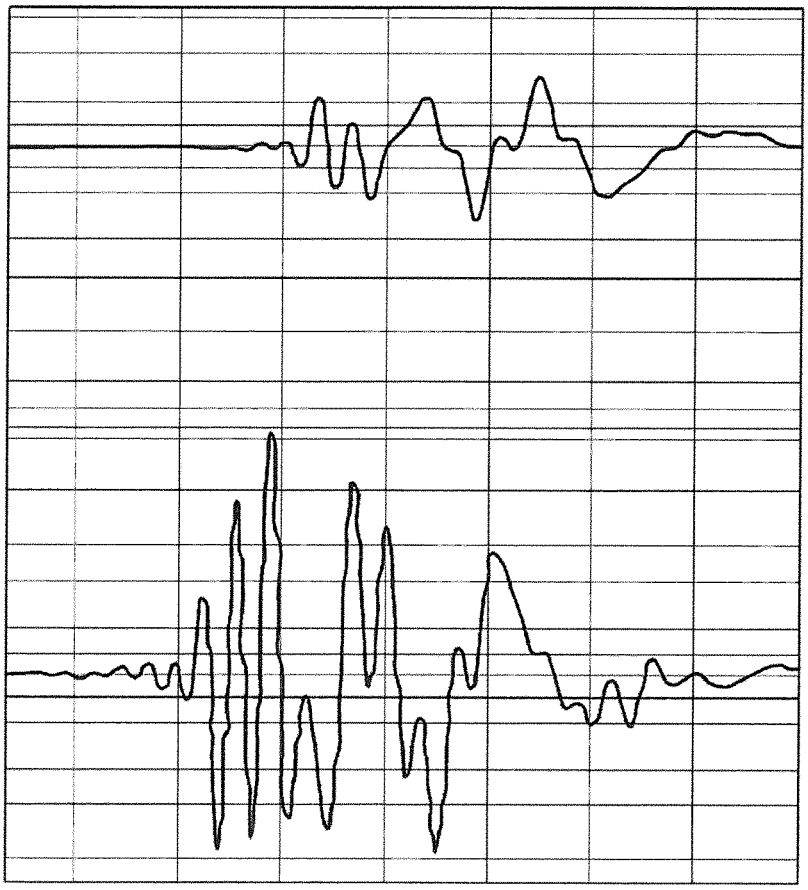
FIG. 12 is a drawing to explain the ILD matching.
Figure 13:
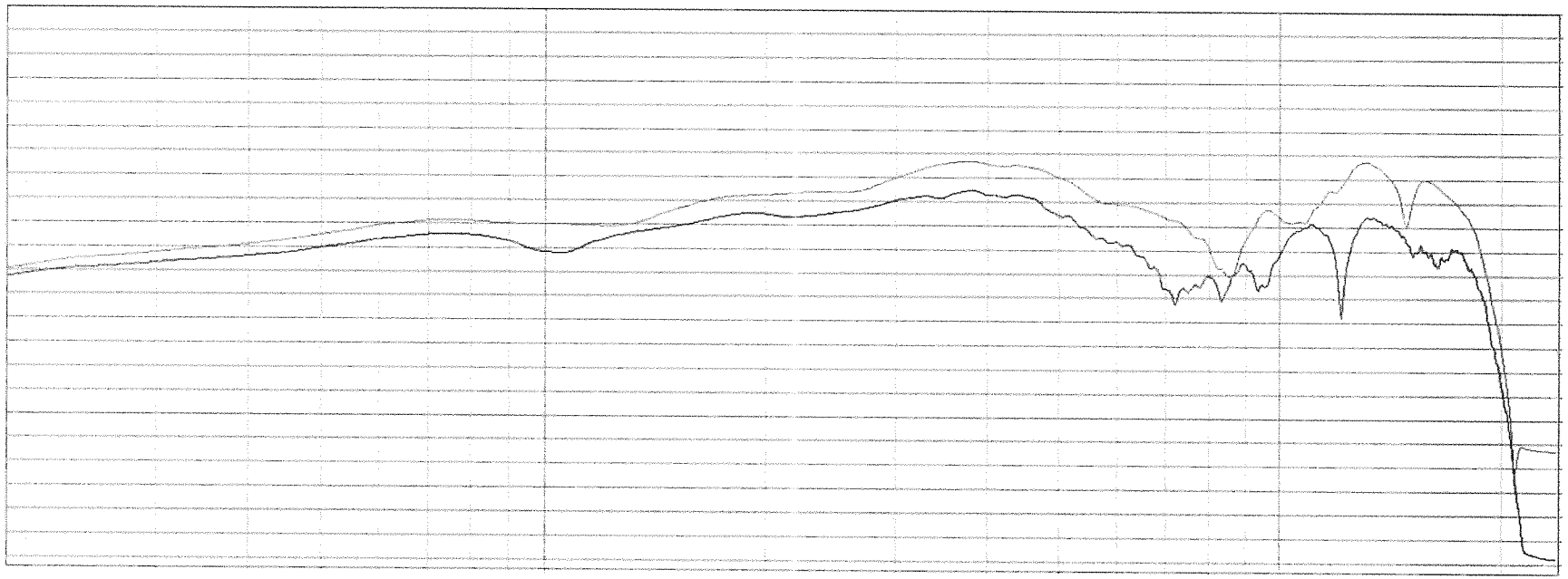
FIG. 13 is a drawing to explain the spectral cue matching.

FIG. 11 is a drawing for explaining ITD matching, FIG. 12 is a drawing for explaining ILD matching, and FIG. 13 is a drawing for explaining spectral cue matching.

Referring to FIG. 11 and FIG. 13, an operation including ITD matching, ILD matching, and spectral cue matching may be performed for individualized filtering in the embodiment of the present invention. Matching uses impulse test to find optimized data from one hundred modeling data, for example, to find the expected HRTF and to find the most similar value by measuring the similarity with one hundred models.

The goal of ITD matching is to find out the reason that humans analyze the time difference of the sound source reaching both ears and recognize it based on the direction. Therefore, since ITD matching time difference occurs when the sound source reaches both ears according to the human head size, a minimum difference of 0.01 ms to 0.05 ms is obtained for the sound source for the left and right 30 degrees angle which is important for the sound image externalization, so for the time difference matching, matching is performed in units of one sample 0.002 ms from 6 samples to 18 samples based on 48000 samples for digital delay correction. The analysis of the matching is to provide the impulse sound source which differs in one sample unit and to select the sound source whose listening is clearest. As a result, the ITD matching clarifies the response of the intelligibility and the transient (initial sound) of the sound image by matching the phase of the sound source, and thus the sound image of the sound source in the 3 dimensional space becomes clear. If the existing ITD is not matched for each individual user, the sound image becomes turbid, a flanging phenomenon (metallic sound) occurs, and an unpleasant sound is transmitted. FIG. 11 illustrates signals provided to a user for ITD matching according to an embodiment of the present invention.

In addition, the purpose of ILD matching is one of the important clues to find out whether the size of the sound reaching the ears is 3D direction. The size of the sound reaching the ears is at least 20 dB to 30 dB at a front left and right 30 degrees angle. It will match the response close to the left and right 30 degrees angle by dividing the impulse response (IR) sound source into 10 steps, the impulse sound source is heard to the listener, and the direction of the sound source is perceived. By matching the ILD, it is possible to predict the size of individual head and to increase the accuracy of the sound image intelligibility and direction recognition by applying the individually optimized HRTF. FIG. 12 illustrates signals provided to a user for ILD matching according to an embodiment of the present invention.

Furthermore, the purpose of the spectral cue matching is to find out that the position of the sound source is different from the original frequency response for each angle as a basis for recognizing the sound source position in the 360 degrees forward, backward, upward and downward in the geometric positions that ITD and the ILD are not distinguished, that is, for the 360-degree direction of the forward, backward, upward and downward. Ten impulse sound sources of different frequency characteristics are played, and the angles of forward, backward, upward and downward are perceived, and the highest accuracy is designated as an individual matching spectral cue. The HRTF using the existing dummy head does not coincide with the spectral cue of the individual auditor, so it is difficult to recognize the front sound image and the upward, backward, and downward directions, but if the spectral cue matches, it can take a clear direction. FIG. 13 illustrates signals provided to a user for a spectral cue according to an embodiment of the present invention.

According to an embodiment of the present invention, the ITD, ILD and spectral cue may find the individualized sample data for each user by a method of matching 100 sample data through a game app that plays a specific impulse sound source or test sound source to find the location of the sound source, and can provide sound source to play by each user based on that sample data.

Figure 14:
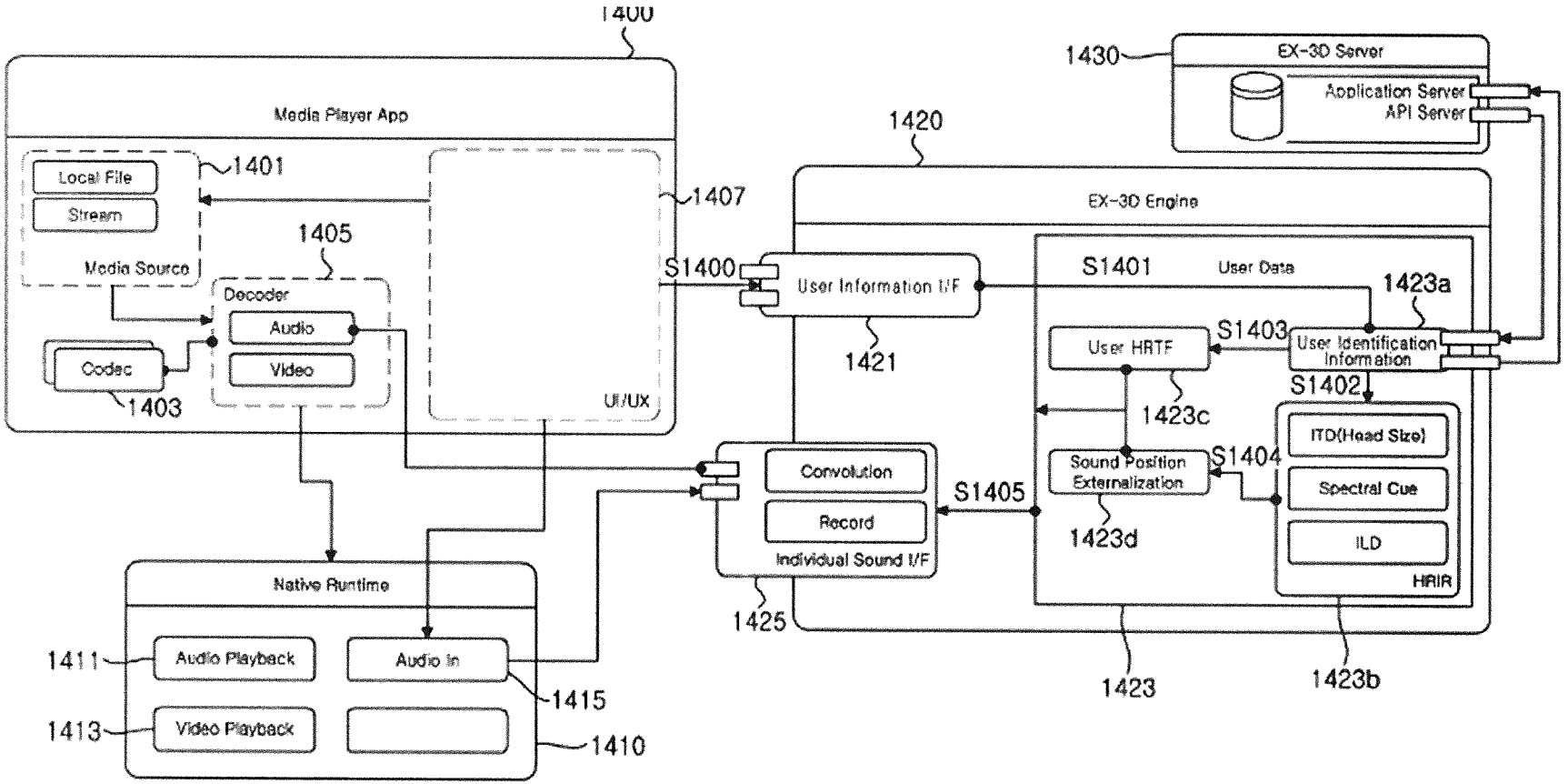
FIG. 14 is a drawing to illustrate the stereophonic service process following the embodiment of the present invention.

FIG. 14 is a drawing for explaining a stereophonic service process according to an embodiment of the present invention. Referring to FIG. 14 and FIG. 1 to explain simply, a media player application 1400 and a native runtime 1410 shown in FIG. 14 are applied to the execution unit of sound output apparatus 100 of FIG. 1, for example, and the 3D engine unit (EX-3D engine) 1420 and the 3D server EX-3D server 1430 in FIG. 14 correspond to the stereophonic service apparatus 120 and the DB 120*a* (or a third-party server) of FIG. 1. In FIG. 14, the 3D engine unit 1420 may receive user information by interfacing with a user and store the user information in the 3D server 1430, S1400, S1401.

In addition, the 3D engine unit 1420 receives input information e.g., ITD, ILD, spectral cue information using a test sound source, by an interface with a user, and sets the individualized HRTF data using the received information S1402, S1403, S1404. More specifically, the 3D engine unit 1402 may determine the user HRTF by matching the user identification information S1403. Of course, one hundred generalized HRTF sample data can be used during this process. In order to form data related to the sound source environment, the 3D engine unit 1402 adds a natural initial reflection sound reflected in the space, for example, to the HRTF in the HRIR unit 1423*b* to form the value to improve the 3 dimensional space audio S1404. Then, the sound image external unit 1423*d* forms the time difference of the sound sources (in combination with the user HRTF) using the set values, and the user can be informed of the individualized HRTF data on the basis of the time difference.

When the selection process of the HRTF data for each user is completed through the above process, the 3D engine unit 1420 will provide audio or video with audio, by changing the output characteristics of image, to the specific user based on the individualized HRFT data if the user wants to play the audio (e.g., music).

FIG. 14 shows a case where the stereophonic output apparatus 100 of FIG. 1 reproduces an audio file acquired by various paths e.g., media source 1401, external reception 1403, etc., the compressed file can be decoded and reproduced through the decoder 1405 and at this time, the audio is reproduced based on the individualized HRTF data for each user in cooperation with the 3D engine unit 1420 to reflect the body characteristics of the user so that the effect of listening to music can be maximized by playing an audio with making similar sound source environment where user is at.

Figure 15:
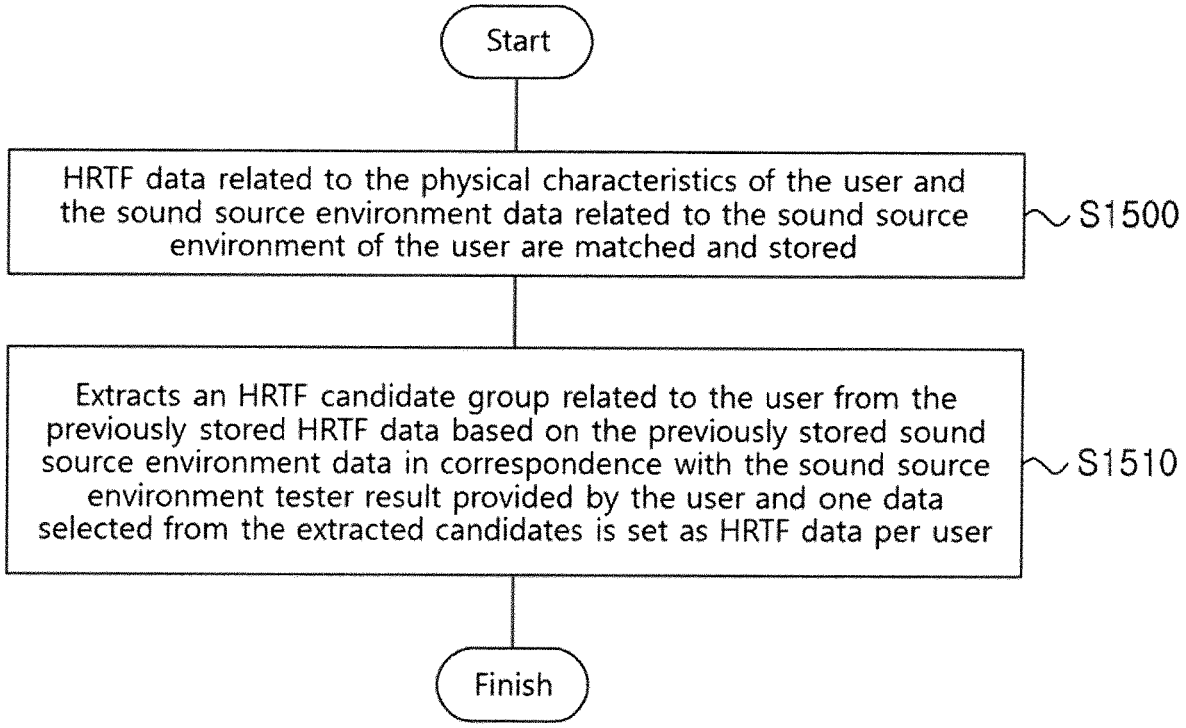
FIG. 15 is a flow chart that shows the operation of a stereophonic service apparatus according to the embodiment of the present invention.

FIG. 15 is a flow chart that shows the operation of a stereophonic service apparatus according to the embodiment of the present invention. Referring to FIGS. 15 and 1 together for convenience of explanation, the stereophonic service apparatus 120 according to the embodiment of the present invention matches and stores HRTF data related to the physical characteristics of a user and sound source environment data related to the sound source environment S1500.

In addition, the stereophonic service apparatus 120 extracts HRTF data candidates related to the user from among the stored HRTF data based on the sound source environment data stored (previously) with the sound source environment test result provided by the user, and one of data selected from the extracted candidates is set as individualized HRTF data for each user S1510.

For example, the stereophonic service apparatus 120 searches one hundred data samples and matches through a game app in which a user is listening to a specific impulse sound source, and grasps the location of the sound source, user's actual environment, to find out the user's HRTF. In other words, HRTF data and sound source environment data are matched and stored, and the HRTF candidate group for each user is extracted through the sound source environment data matching the input information based on the input information of the user input through the test using the impulse sound source, and HRTF having the highest similarity among the extracted candidates, that is, HRTF higher than the reference value is used as HRTF data of the user. Of course, the candidate group extracted as in the embodiment of the present invention may be compared with previously stored HRTF data to measure similarity and may use that measurement result.

For example, suppose that five candidates are selected first. At this time, there may be a method of comparing HRTF data with a preset reference value to find HRTF data having the highest similarity in the candidate group. Alternatively, a method of sequentially excluding specific HRTF data by comparing candidate groups may also be used. As described above, in the embodiment of the present invention, there are various ways of finding the HRTF data finally matching with a specific user; therefore, the embodiment of the present invention is not limited to any one method.

In the meantime, the present invention is not necessarily limited to these embodiments, as all the constituent elements of the embodiment of the present invention are described as being combined or operated in one operation. That is, within the scope of the present invention, all of the elements may be selectively coupled to one or more of them. In addition, although all of the components may be implemented as one independent hardware, some or all of the components may be selectively combined to be implemented as a computer program having a program module that performs some or all of the functions combined in one or a plurality of hardware. The codes and code segments that make up the computer program may be easily deduced by those skilled in the art of the present invention. Such a computer program may be stored in non-transitory computer-readable media, and it can be readable and executed by a computer; thereby it can realize an embodiment of the present invention. Here, the non-transitory readable recording media are not a medium for storing data for a short time such as a register, a cache, a memory, etc., but it means a medium which semi-permanently stores data and is capable of being read by a device. Specifically, the above-described programs may be stored and provided in non-transitory readable recording media such as CD, DVD, hard disk, Blu-ray disc, USB, memory card, ROM and so on.

While the present invention has been particularly shown and described with reference to exemplary embodiments thereof, it is clearly understood that the same is by way of illustration and example only and is not to be construed as limiting the scope of the invention. It will be understood by those skilled in the art that various changes in form and details may be made therein without departing from the spirit and scope of the invention as defined in the appended claims.

DESCRIPTION OF REFERENCE NUMERALS

100: Stereophonic output apparatus
110: Communication network
120, 120': Stereophonic service apparatus
200: Stereophonic individualized processor unit
210, 330: Storage unit
300: Communication interface unit
310: Control unit
320: Stereophonic individualized execution unit

What is claimed is:

1. A stereo sound service device configured to provide a stereo sound service personalized to a user via a stereo sound output device capable of setting a sound condition optimized for the user by reflecting innate physical characteristics of the user in the form of a head related transfer function, executing a program for outputting sounds personalized according to the user, and selecting sample data that is the most appropriate for physical characteristics of the user based on input information pertaining to the user from pre-stored matching sample head related transfer function data, the stereo sound service device comprising:

a stereo sound personalization processing unit configured to set sound data personalized according to the user, including head related transfer function data related to the physical characteristics of the user and sound source environment data related to an actual sound source environment for the user matched to the head related transfer function data, and to provide the sound data personalized according to the user to a stereo sound output device;

wherein the stereo sound personalization processing unit comprises a communication interface unit configured to provide the head related transfer function data personalized according to the user and the sound source environment data to the stereo sound output device, to provide an application for a stereo sound service, and to receive user identification information;

a control unit configured to receive the user identification information received to the communication interface unit, and to execute retrieval of data personalized according to users, which is matched to the input information based on user input information received via the communication interface unit depending on a user request; and a stereo sound personalization executing unit configured to retrieve the personalized head related transfer function data via the sound source environment data, and to execute an audio conversion operation based on data set by performing an operation of setting the head related transfer function data personalized according to the users and the sound source environment data;

wherein the control unit acquires a sound source environment test result by performing an impulse test for confirming an inter-aural time difference of a sound, an inter-aural level difference of sound pressure, and a spectral queue via a sound output device of the user, the control unit executes a head related transfer function data candidate group related to the user among head related transfer function data stored in a storage unit based on the sound source environment data matched to the sound source environment test result, and the control unit measures similarity by comparing the executed head related transfer function data candidate group with pre-stored head related transfer function data and sets head related transfer function data having the highest similarity measurement value to personalized head related transfer function data of the user;

wherein the sound source environment data is created by alpha filtering composed of a frequency characteristic change and a time difference characteristic change, and the stereo sound service device further comprises a database, and the database stores sample data for setting the head related transfer function data personalized according to the users and stores the personalized head related transfer function data set according to the users by using the sample data.

2. The stereo sound service device according to claim 1, wherein the stereo sound service device receives and stores the sample data for personalization processing from the database, and further comprises storage units configured to provide the sample data upon a request from the stereo sound personalization processing unit, and wherein the storage units store the head related transfer function datam and match the head related transfer function data personalized according to the users, and the sound source environment datam to the user identification information by using the provided sample data, and the sound source environment data acquires a plurality of signals by dividing frequency characteristics and time difference characteristics of a random signal into a plurality of sections.

3. The stereo sound service device according to claim 2, wherein the stereo sound personalization processing unit retrieves data for a certain user from a plurality of sample data stored in the storage unit based on the input information supplied though an interface with a user, sets the data to data specialized to a certain individual user, and provides an audio service by changing and processing an audio signal by employing the set data.

4. A method for driving a stereo sound service device configured to provide a stereo sound service based on a set value that is the most similar to physical characteristics of a certain user according to the users and an actual sound source environment, to a user of a stereo sound output device including storage units and a control unit, the method comprising:

the step of matching and storing, in the storage units, head related transfer function data related to physical characteristics of the user and three dimensional sound source environment data related to a sound source environment of the user; and the step of extracting a head related transfer function candidate group according to the users via sound source environment data matched to corresponding input information based on input information of the user which is input through a test using an impulse sound source in a state that the control unit has matched and stored the head related transfer function data and the sound source environment data, and then, setting the head related transfer function candidate group more than a reference value having the highest similarity to pre-stored head related transfer function data among the extracted head related transfer function candidate groups to be used as personalized head related transfer function data according to the users;

wherein the matching and storing comprise storing the sound source environment data matched to each of the head related transfer function data, in which the sound source environment data divides frequency characteristics and time difference characteristics of a random signal into each of a plurality of sections;

wherein the matching and storing comprises extracting the sound source environment data related to a plurality of signals matched to a test result of a sound environment, to a candidate group;

wherein the extracting and setting comprises performing an impulse test of executing an operation including ITD matching of a sound, ILD matching of sound pressure and a spectral queue matching for personalization filtering;

wherein the extracting and setting comprises using a game application for identifying a location of a sound source by allowing the user to listen to a certain impulse sound source via a sound output device for the impulse test;

wherein the extracting and setting comprises setting a candidate having the highest similarity measurement value to personalized head related transfer function data of the user by measuring similarity between the head related transfer function data of the extracted candidate group and the stored head related transfer function data;

wherein the sound source environment data is matched and pre-stored to the head related transfer function data, and is created by alpha filtering; and wherein the alpha filtering includes a frequency characteristic change to progress a smoothing task based on a predetermined octave band after decreasing a peak band of a specific frequency by a predetermined decibel value, and a time difference characteristic change to be progressed in a form of an original sound source plus a predetermined time interval plus a first reflective sound plus a predetermined time interval plus a second reflective sound plus a predetermined time interval plus a third reflective sound.

5. The method according to claim 4, wherein the stereo sound service device extracts the HRTF candidate group according to the users via the sound source environment data matched to the corresponding input information based on user input information which is input through a test using the impulse sound source in a state that the head related transfer function data and the sound source environment data are matched and pre-stored, and these stereo sound service devices set and use one of the head related transfer function candidate groups more than a reference value having the highest similarity to the pre-stored head related transfer function data among the extracted HRTF candidate group, to the personalized head related transfer function data of the user, and the stereo sound service devices further comprise a database, wherein in the database, the sample data for setting the head related transfer function data personalized according to the users is stored, and the personalized head related transfer function data set according to the users is stored using the sample data.

6. The method according to claim 4 wherein:

a stereo sound service method according to a method for driving stereo sound service devices comprises an execution-denial media player app, a native runtime, an EX-3D engine and an EX-3D server as executing units;

the EX-3D engine receives user information by an interface with the user;

the EX-3D server stores the user information;

the EX-3D engine receives input information on ITD of a sound, ILD of sound pressure and a spectral queue using a test sound source by the interface with the user;

the EX-3D engine comprises executing an operation of setting the head related transfer function data personalized according to the users by using the input information;

the EX-3D engine comprises forming a setting value for three-dimensional spatial audio by allowing a head related impulse response unit to add an initial reflective sound reflected from space to an head related transfer function and form a head related impulse response in order to form sound source environment data; and a time difference of the sound source is formed in the head-related impulse response unit by using the setting value, based on which the personalized head related transfer function data according to the users is determined, and when determining the personalized head related transfer function data according to the users, if an audio is played back by the user, the EX-3D engine changes and provides output characteristics of an audio or a video including the audio based on the head related transfer function data personalized to a certain user.

* * * * *